US005318630A

United States Patent [19]

Akin et al.

[11] Patent Number: 5,318,630

[45] Date of Patent: Jun. 7, 1994

[54] SYSTEM FOR INSULATING WIRE INCLUDING A WIRE TENSIONING DEVICE

[75] Inventors: Mickey E. Akin, Haralson County; Stephen C. Bohannon, Coweta County; Darrell L. Harrison, Haralson County; Michael L. McCloud, Carroll County, all of Ga.

[73] Assignee: Southwire Company, Carrollton, Ga.

[21] Appl. No.: 990,490

[22] Filed: Dec. 14, 1992

[51] Int. Cl.[5] ..... B05D 3/12; B05D 7/20

[52] U.S. Cl. ..... 118/33; 427/175; 226/195; 242/147 A; 242/149; 242/151; 242/155 R

[58] Field of Search ..... 425/113; 118/33; 427/175; 242/147 A, 149, 151, 155 R; 226/195

[56] References Cited

U.S. PATENT DOCUMENTS

| | | | |
|---|---|---|---|
| 3,185,616 | 5/1965 | Zernov et al. | 118/33 |
| 3,312,414 | 4/1967 | Knapp | 242/151 |
| 3,520,492 | 7/1970 | Brown | 242/155 R |
| 4,291,644 | 9/1981 | Kawai et al. | 118/33 X |
| 4,773,954 | 9/1988 | Starnes, Jr. | 156/24.12 |

*Primary Examiner*—Michael W. Ball
*Assistant Examiner*—Francis J. Lorin
*Attorney, Agent, or Firm*—James W. Wallis, Jr.; Stanley L. Tate; George C. Myers, Jr.

[57] ABSTRACT

A wire tensioning device having a guide for taking up an advancing wire having slack and a brake for applying a braking force to the guides. In a wire insulating system, a wire from a supply reel or spool is passed to a take-up reel or spool, through intervening components, which accumulate, tension and apply insulation to the advancing wire. The wire is first passed from the supply reel to an accumulating device in the form of a vertical accumulator or a flipper payout. From there it is passed through the device of the present invention having a plurality of rotatable sheaves or pulleys about which the advancing wire is trained. A braking force is applied to one of the sheaves by an air brake to apply a tensioning force. From the tensioning device, the wire is fed through an insulation-applying crosshead device and then on to a take-up reel or spool.

21 Claims, 2 Drawing Sheets

SYSTEM FOR INSULATING WIRE INCLUDING A WIRE TENSIONING DEVICE

FIELD OF THE INVENTION

The present invention relates to the tensioning of wire as it is advanced through a crosshead device for applying one or more layers of insulation to the wire.

BACKGROUND OF THE INVENTION

When insulation is to be applied to a wire, the wire is fed from a spool to an accumulating device and then into a crosshead device having tooling including a die which guides or positions the wire so that one or more layers of insulating material can be applied thereto. A crosshead device which is useful in such applications is disclosed in U.S. Pat. No. 4,773,954, commonly assigned to the assignee of the present invention, the teachings of which patent are incorporated herein by reference.

In passing a wire through a crosshead device for the application of insulation, it is very important that the wire be properly oriented within the die of the tooling so that a layer or layers of insulation are applied having a uniform circumferential distribution or concentricity about the wire. Such proper orientation of the wire is achieved by applying a proper tension on the wire such that it passes through the center of the die in the tooling of the crosshead device. Slack or sagging of the wire as it passes through the crosshead device results in improper alignment of the wire relative to the insulation applying portions of the crosshead device. As a result, a non-uniform distribution of coating of insulation is applied.

SUMMARY OF THE INVENTION

The present invention addresses the difficulties in maintaining the proper alignment and orientation of an advancing wire as it passes through an insulation-applying crosshead.

In the present invention, an advancing wire from a supply reel or spool is passed to a take up reel or spool, through intervening components, which accumulate, tension and apply insulation to the wire. The wire is first passed from the supply reel to an accumulating device in the form of a vertical accumulator or a flipper payout. From there it is passed through a guide in the form of a device having a plurality of rotatable sheaves or pulleys about which the wire is trained. A braking force is applied to one of the sheaves by an air brake, or other suitable means, to apply a tensioning force. From the tensioning device, the wire is fed through an insulation-applying crosshead device and then on to a take-up reel or spool.

The present invention has the advantage of simplicity in construction and operation while providing effective tensioning to permit proper alignment of the wire. The tensioning device can be observed by a human operator and operated by manual adjustment of air pressure to the air brake. Alternatively, it is contemplated that by proper calibration, the device can be operated under automatic or computer control in response to sensed signals of wire slack or tension.

With the foregoing and other advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
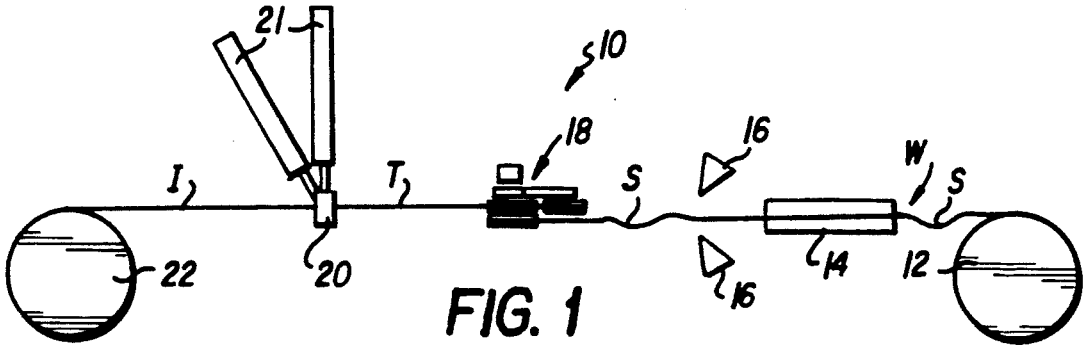
FIG. 1 is a schematic diagram of an insulation applying system.

Referring now to the drawings in detail, there is illustrated in FIG. 1 a schematic illustration of a wire insulating system, designated generally by the numeral 10. A wire W, showing exaggerated sagging or slack S, is fed from a supply reel or spool 12 to a vertical accumulator 14 or, alternatively, one or more flipper payouts 16, as known in the art. From there, the wire W is fed to a tensioning device, designated generally by the numeral 18. The tensioning device 18 eliminates the slack S from the wire W, with the wire W leaving the tensioning device 18 showing a proper tension T.

From tensioning device 18, the tensioned wire T enters crosshead 20, fed by insulation extruders 21. Crosshead 20 has a guide or die having a bore, not shown, through which the wire W passes and in which the wire W must be properly aligned or oriented in order to maintain proper concentricity of the applied insulation layer or layers. After one or more layers of insulation are applied to the tensioned wire T, it exits the crosshead 20 as insulated wire I and is taken up on take-up reel or spool 22. The drive mechanism for moving the wire W from the supply reel 12 to the take-up reel 22 may be by a motor which rotates take-up reel 22 (not shown) or, alternatively, by pinch wheels (also not shown) which engage the periphery of the wire W along its path of travel. The initial slack S in the wire W results from internal friction within the various components such that a uniform tension is not maintained throughout the length of the entire insulation applying system, and hence, must be compensated for.

Figure 2:
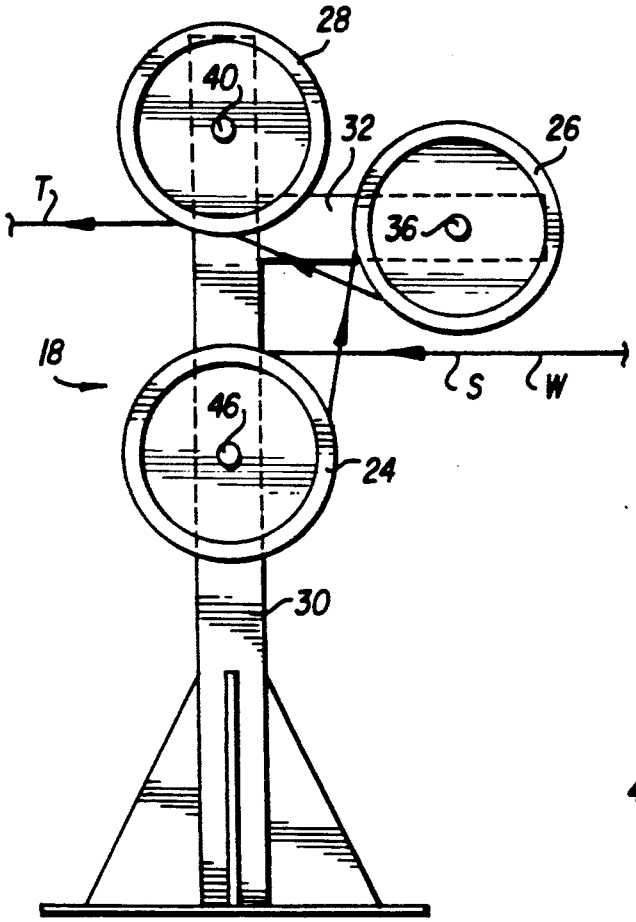
FIG. 2 is a side view of a tensioning device according to the present invention.
Figure 3:
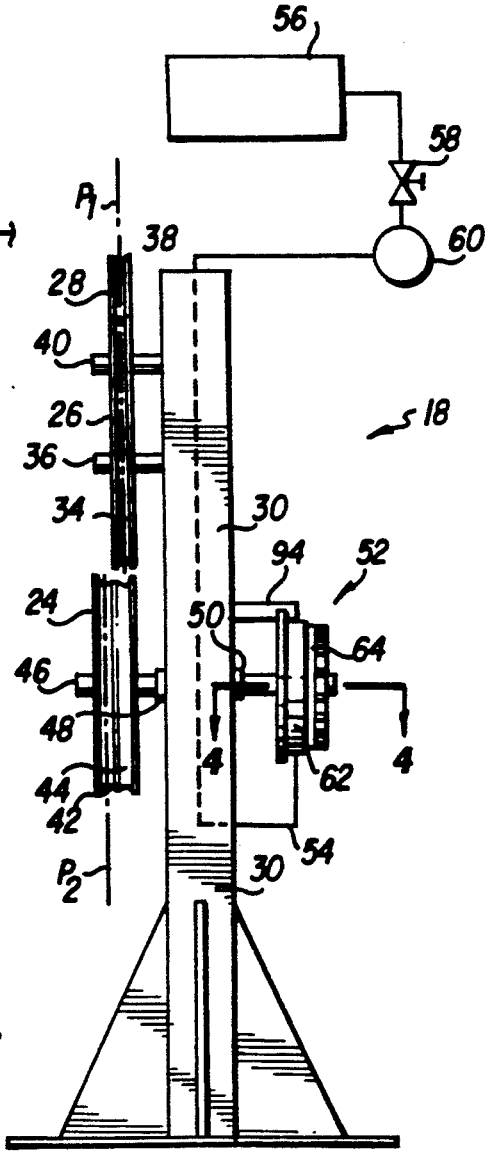
FIG. 3 is an end view of a tensioning device according to the present invention.

FIGS. 2 and 3 show the tensioning device 18 according to the present invention. Tensioning device 18 includes a take-up sheave 24, an intermediate sheave 26, and a payout sheave 28, each of which is mounted rotatably on a vertical frame 30, having a substantially horizontal offset beam 32. Intermediate sheave 26 having race 34 is mounted on shaft 36, fitted with appropriate bearings (not shown). Similarly, payout sheave 28 having race 38 is mounted on shaft 40, also fitted with appropriate bearings (not shown).

Take-up sheave 24 has dual races 42, 44 and is mounted on a shaft 46, rotatably supported on frame 30 by bearings 48, 50. Take-up sheave 24 is aligned with intermediate sheave 26 and payout sheave 28 such that races 34, 38 and 44 are substantially coplanar in plane $P_1$ with race 42 in a parallel plane $P_2$ displaced from the plane of races 34, 38 and 44. As described below, an air brake 52 is mounted on shaft 46. Air line 54 runs from air supply 56 through valve 58 to air brake 52 and is monitored by gauge 60.

Figure 4:
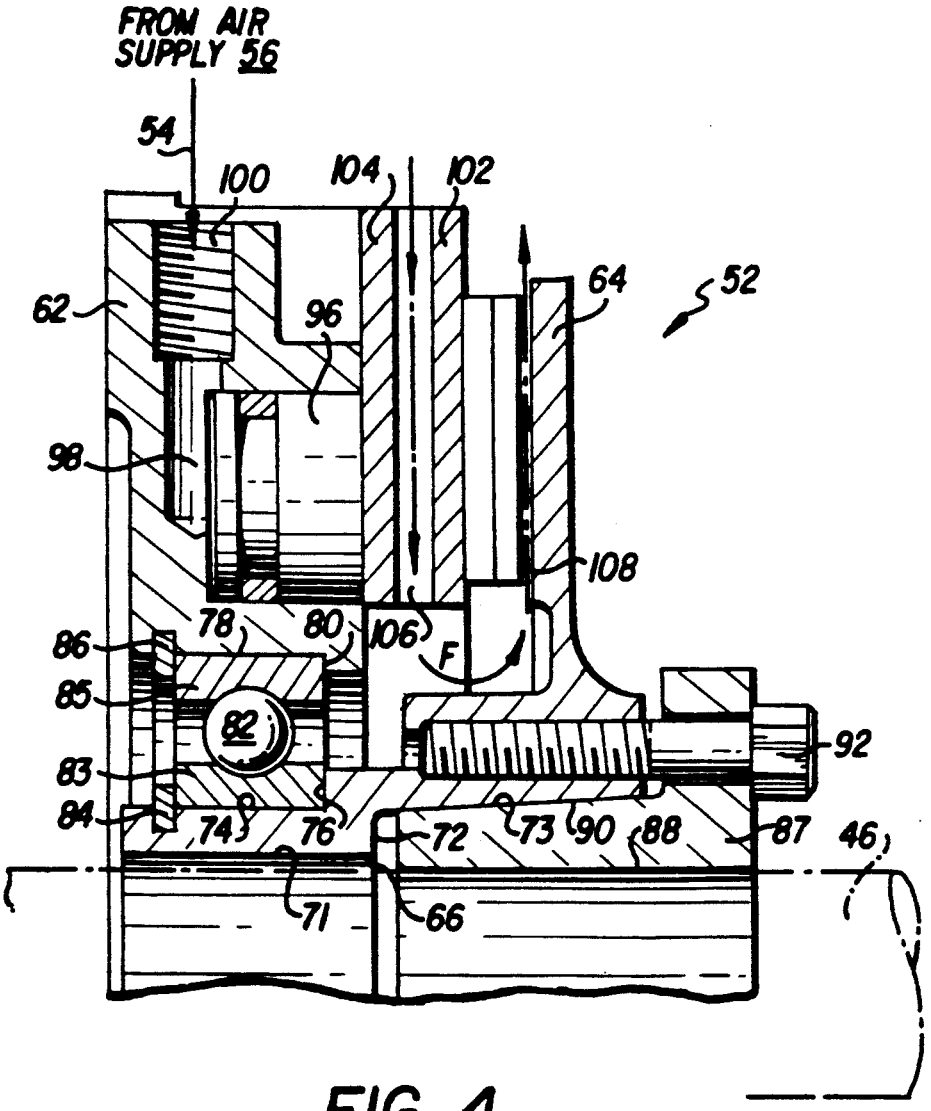
FIG. 4 is an enlarged fragmentary sectional view taken along line 4—4 of FIG. 3 and rotated 180° and illustrates details of the air brake used in the tensioning device of FIGS. 2 and 3.

As shown in FIG. 4, air brake 52 is mounted on shaft 46 (shown in phantom) so as to apply a braking force to shaft 46 and hence to take-up sheave 24 also mounted thereon. Air brake 52 is comprised of a housing 62 and a rotary drum 64. Rotary drum 64 includes a bore 66 having a cylindrical portion 71, a shoulder 72 and a tapered cylindrical portion 73. A bearing surface 74 having a shoulder 76 is provided concentric to the cylindrical bore 66. Housing 62 has a cylindrical bore 78 formed therein having a shoulder 80. Roller bearings 82 housed in rings 83, 85 are mounted by circlips or snap rings 84, 86 in the bearing surface 74 and bore 78 to permit rotation between housing 62 and drum 64. Bushing 87 having cylindrical bore 88 and tapered surface 90 is fastened by bolts 92 to drum 64. As a result of the contact of tapered surfaces 73 and 90, a wedging action is provided so that bushing 87 can be tightened onto shaft 46. Torque pin 94 (FIG. 3) is provided on frame 30 so as to engage a groove (not shown) in housing 62, thereby preventing rotation of housing 62 and causing it to remain stationary. Mounted within housing 62 is an annular piston 96 which communicates on one side with a plenum 98 attached at fitting 100 to the air supply 56 by air line 54. Rotary drum 64 is lined with a layer 102 of brake pad material which is engaged by a layer 104 of brake pad material in contact with annular piston 96. The brake pad layers 102, 104 and drum 64 are configured to provide air passages 106 and 108, respectively, so that a stream F of air is allowed to flow therethrough, to permit cooling of the brake pad layers 102, 104 and drum 64. When air pressure from air supply 56 is applied to piston 96, the brake pad layers 102, 104 are pressed against each other, thereby retarding the rotation of drum 64. This, in turn, retards the rotation of shaft 46 on which drum 64 is mounted and upon which take-up sheave 24 is mounted. As explained below, this is the braking force which tensions wire W. Air brake 52 may be, for example, a model selected from Models T-450, T-600, T-800, or T-1000 manufactured by Horton Manufacturing Co., Inc., Minneapolis, Minn.

The system operates as follows: When wire W is paid out from supply reel 12 through vertical accumulator 14, (or, alternatively, through flipper pay outs 16), slack S occurs in the wire W. The wire W is trained about outer race 42 of take-up sheave 24 and then about race 34 of intermediate sheave 26 and finally about race 38 of payout sheave 28. From there, as discussed above, the wire W is passed to crosshead 20. When slack S is detected in wire W, either visually by a human operator, or automatically by a calibrated means (not shown), valve 58 is actuated to supply air through line 54 to air brake 52. As explained above, this air actuates the piston 66 in air brake 52 which in turn presses brake material layer 74 against brake material 76 on rotatable brake drum 70. This results in a braking force being applied to shaft 46 which, in turn, slows the rotation of take-up sheave 24. This results in an increase in the tension in wire W as it passes about take-up sheave 24, intermediate sheave 26 and payout sheave 28. The amount of increased tension is adjustable by increasing or decreasing the air flow to air brake 52.

Although a certain presently preferred embodiment of the invention has been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A system for applying insulation to an advancing wire, said wire being supplied from a supply reel and being taken up by a take-up reel after insulation is applied, comprising:

a wire tensioning device including:

a frame;

a plurality of sheaves, each said sheave having at least one race therein, said races aligned and adapted to receive a wire and about which said advancing wire is to be trained, said sheaves mounted on said frame and having fixed axes; and a brake for applying a braking force to only one of said sheaves; and means for applying insulation to said advancing wire received from said wire tensioning device, thereby producing insulated wire and sending said insulated wire to said take-up reel;

whereby the wire tensioning device receives said advancing wire having slack therein and transmits said advancing wire having a greater tension than the tension of the slack wire.

2. A system as in claim 1, wherein said brake is an air brake.

3. A system as in claim 1, wherein said plurality of sheaves comprises a take-up sheave, an intermediate sheave and a payout sheave.

4. A system as in claim 3, wherein said brake applies a braking force to said take-up sheave.

5. A system as in claim 3, wherein said take-up sheave includes a race located in a plane parallel to a plane defined by coplanar races in said intermediate sheave and said payout sheave.

6. A system as in claim 3, wherein said take-up sheave and said payout sheave are each mounted to be substantially vertically aligned with said intermediate sheave offset horizontally from said take-up sheave and said payout sheave.

7. A system as in claim 2, wherein said air brake is manually operable in response to a visual observation of slack in the wire to be tensioned.

8. A system for applying insulation to an advancing wire supplied by a supply reel and taken up by a take-up reel, comprising:

an accumulator for receiving said advancing wire from a supply reel and for transmitting said wire to a wire tensioning device;

said wire tensioning device including a frame, a plurality of sheaves, each said sheave having at least one race therein, said races aligned and adapted to receive a wire to be trained thereabout, said sheaves mounted on said frame and having fixed axes; and a brake for applying a braking force to only one of said sheaves, whereby the plurality of sheaves receive said advancing wire from said accumulator having a slack therein and transmit said advancing wire having a greater tension than the tension of the slack wire; and a crosshead device for applying one or more layers of insulation to said advancing wire received from said wire tensioning device, thereby producing insulated wire and sending said insulated wire to said take-up reel.

9. A system as in claim 8, wherein said brake is an air brake.

10. A system as in claim 8, wherein said plurality of sheaves in said wire tensioning device comprises a take-up sheave, an intermediate sheave and a payout sheave.

11. A system as in claim 10, wherein said brake applies a braking force to said take-up sheave.

12. A system as in claim 10, wherein said take-up sheave includes a race located in a plane parallel to a plane defined by coplanar races in said intermediate sheave and said payout sheave.

13. A system as in claim 10, wherein said take-up sheave and said payout sheave are each mounted to be substantially vertically aligned with said intermediate sheave offset horizontally from said take-up sheave and said payout sheave.

14. A system as in claim 9, wherein said air brake is manually operable in response to a visual observation of slack in the wire to be tensioned.

15. A system for applying insulation to an advancing wire in which the wire is fed from a supply source to a take-up source comprising: a wire tensioning device located between said supply source and said take-up source comprising:

a guide having a plurality of races therein for taking up said advancing wire having slack therein, said races having fixed axes and aligned and adapted to receive said wire and about which said advancing wire is to be trained, and a brake for applying a braking force to only one said guide race, and a crosshead device for applying insulation to said wire, whereby the slack in the wire is taken up by the braking force applied to said guide prior to advancing to said crosshead device.

16. A system for applying insulation to an advancing wire, said wire being supplied from a supply reel and being taken up by a take-up reel after insulation has been applied, comprising:

a wire tensioning device comprising:

a frame, a take-up sheave, an intermediate sheave, and a payout sheave, each said sheave mounted on said frame and having a fixed axis of mounting and rotation and at least one race for receiving a wire, and a brake for applying a brake force to only said take-up sheave, whereby said advancing wire is trained about said take-up sheave, said intermediate sheave and said payout sheave so as to receive said advancing wire having slack therein and transmit said advancing wire having a greater tension than the tension of the slack wire; and means for applying insulation to said advancing wire received from said wire tensioning device, thereby producing insulated wire and sending said insulated wire to said take-up reel.

17. A wire tensioning device as in claim 16, wherein said sheaves each have the same diameter.

18. A wire tensioning device as in claim 16, wherein said brake is mounted to said frame, said frame including a torque pin for preventing rotation of said brake.

19. A system for applying insulation to an advancing wire supplied by a supply reel and taken up by a take-up reel, comprising:

an accumulator for receiving said advancing wire from a supply reel and for transmitting said wire to a wire tensioning device;

said wire tensioning device including:

a frame, a take-up sheave, an intermediate sheave, and a payout sheave, each said sheave mounted on said frame and having a fixed axis of mounting and rotation and having at least one race for receiving a wire, and a brake for applying a brake force to only said take-up sheave, whereby said sheaves receive said advancing wire having slack therein and transmit said advancing wire having a greater tension than the tension of the slack wire; and a crosshead device for applying one or more layers of insulation to said advancing wire received from said wire tensioning device, thereby producing insulated wire and sending said insulated wire to said take-up reel.

20. A system as in claim 19, wherein said sheaves each have the same diameter.

21. A system as in claim 19, wherein said brake is mounted to said frame, said frame including a torque pin for preventing rotation of said brake.

* * * * *